US005766037A

United States Patent [19]

Nelson

[11] Patent Number: 5,766,037

[45] Date of Patent: Jun. 16, 1998

[54] CONNECTOR FOR A RADIO FREQUENCY CABLE

[75] Inventor: James W. Nelson, Cheshire, Conn.

[73] Assignee: Radio Frequency Systems, Inc., Marlboro, N.J.

[21] Appl. No.: 729,503

[22] Filed: Oct. 11, 1996

[51] Int. Cl.[6] ..... H01R 9/05

[52] U.S. Cl. ..... 439/583

[58] Field of Search ..... 439/578, 583, 439/584, 585, 322, 805, 98, 99

[56] References Cited

U.S. PATENT DOCUMENTS

| | | | |
|---|---|---|---|
| 3,291,895 | 12/1966 | Van Dyke | 174/88 |
| 5,137,470 | 8/1992 | Doles . | |
| 5,167,533 | 12/1992 | Rauwolf . | |
| 5,435,745 | 7/1995 | Booth . | |

FOREIGN PATENT DOCUMENTS

| | | | |
|---|---|---|---|
| 0495467 | 1/1992 | European Pat. Off. | H01R 17/12 |
| 0722199 | 7/1996 | European Pat. Off. . | |
| 4344328 | 12/1995 | Germany . | |

*Primary Examiner*—Gary F. Paumen
*Assistant Examiner*—Yong Ki Kim
*Attorney, Agent, or Firm*—Ware, Fressola, Van Der Sluys & Adolphson, LLP

[57] ABSTRACT

A self clamping connector 10 for a radio frequency coaxial cable having a helically corrugated outer conductor 14 which does not require flaring of the outer conductor of the cable is disclosed. The connector includes a clamping back nut 30 having a plurality of resilient fingers 32 at one end. Each of the resilient fingers 32 have an outer conductor matching threaded portion 38. A cup shaped collet 40, further including a base 42 having an opening 44 therein, is positioned over the resilient fingers 32 to clamp the fingers 32 onto the helically corrugated outer conductor. The cup shaped collet 40 also enables the connector to collapse part of the outer conductor corrugation. The collapsed corrugation is held between the collet and the resilient fingers. A body 50, having threading to enable coupling to the clamping back nut 30, forces the cup shaped collet to remain over the resilient fingers when the connector is in the assembled state.

9 Claims, 4 Drawing Sheets

CONNECTOR FOR A RADIO FREQUENCY CABLE

BACKGROUND OF THE INVENTION

1. Field of the Invention

The present invention generally relates to cable connectors for connecting coaxial radio frequency cables to radio frequency equipment, antennas or other radio frequency cables. More particularly, the present invention relates to a self clamping connector for radio frequency cables with corrugated helical outer conductors.

2. Description of the Prior Art

Connectors for radio frequency cables having helically corrugated outer conductors generally require a means to firmly grasp or secure the connector to the outer conductor of the cable. Van Dyke, U.S. Pat. No. 3,291,895, discloses a tab flare which is used to secure the connector to the outer conductor. Vaccaro et al, European Patent application No. 495467, Doles, U.S. Pat. No. 5,137,470 and Rauwolf, U.S. Pat. No. 5,167,533 disclose connector assemblies which include a flaring ring and a clamping member having opposed bevelled surfaces for engaging the respective inner and outer surfaces of the outer conductor of the cable. A body member draws and hold the bevelled surface of the flaring ring and the clamping member together against opposite surfaces of the outer conductor of the cable. One drawback of these assemblies is that they require extra steps to be taken to secure the connector to the outer conductor of the cable.

SUMMARY OF THE INVENTION

It is one object of the present invention to provide a self clamping radio frequency cable connector that is simple to attach to a radio frequency cable.

It is another object of the present invention to provide a self clamping radio frequency cable connector that can be reused.

Other objects and advantages of the invention will be apparent from the following detailed description and the accompanying drawings.

In accordance with the present invention, the foregoing objectives are realized by providing a self-clamping connector for a radio frequency coaxial cable having a helically corrugated outer conductor. The connector of the present invention comprises an outer conductor clamping back nut having a plurality of resilient fingers at one end, and a threaded portion adjacent to the resilient fingers. Each of the resilient fingers includes an outer conductor matching threaded portion. The connector also further comprises a cup shaped collet which further includes a base having an opening therein. The cup shaped collet is positioned over the resilient fingers to clamp the fingers to the helically corrugated outer conductor. The connector also includes a body which has an interior threaded portion at one end, a coupling at an opposite end, a collet supporting shoulder therein on which the cup shaped collet rests when the connector is assembled.

In another embodiment, the body also includes an insert supporting shoulder. In this embodiment, the connector is also provided with an insert having an opening therein. The insert is positioned between the base of the cup shaped collet and the insert supporting shoulder of the body when the connector assembly is assembled.

BRIEF DESCRIPTION OF THE DRAWINGS

The drawings, not drawn to scale, include.

DETAILED DESCRIPTION OF THE PRESENT INVENTION

Figure 1:
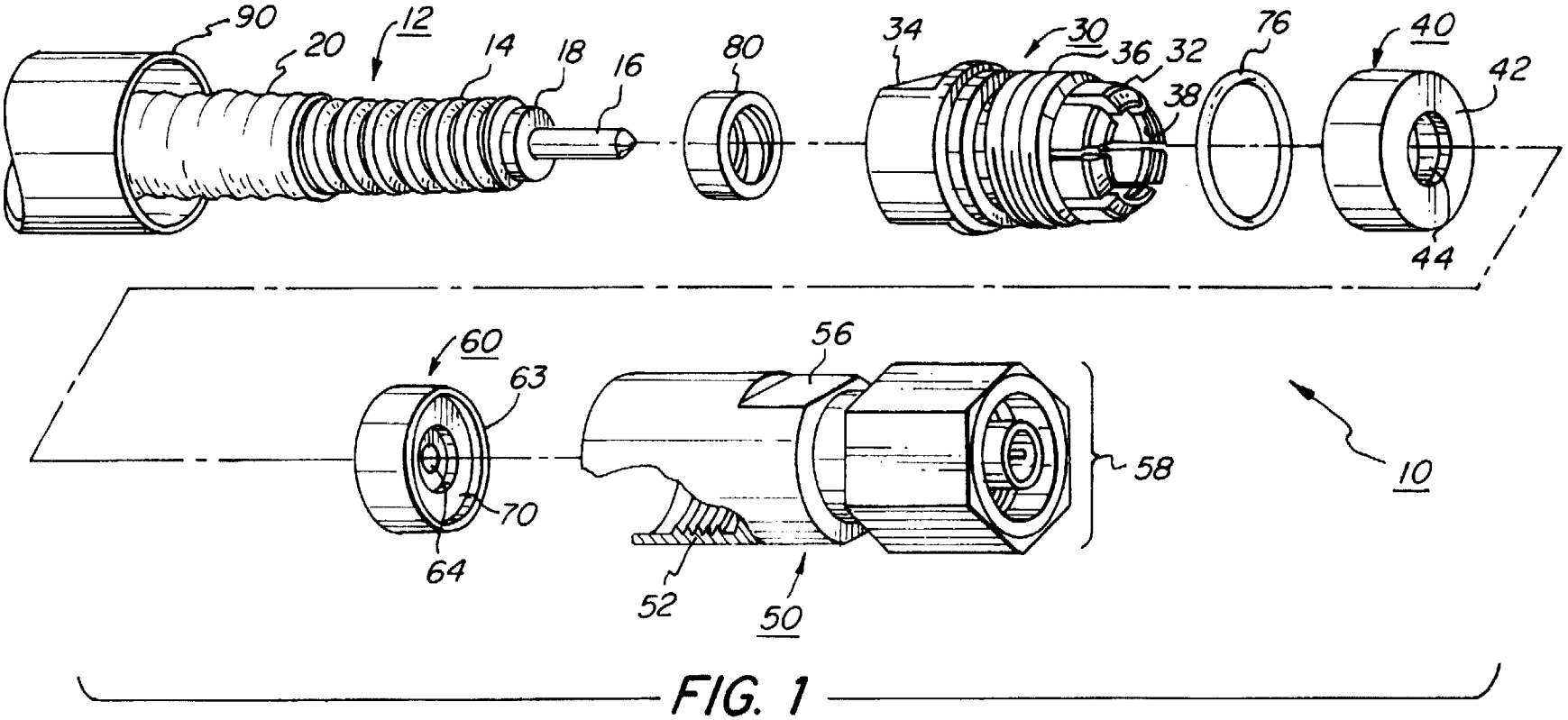
FIG. 1 which is an exploded perspective view of the coaxial cable connector of the present invention.

As shown in the exploded perspective view of FIG. 1, the present invention is a self clamping connector, generally shown as 10, intended for use with a coaxial radio frequency (RF) cable, generally shown as 12, having a helically corrugated outer conductor 14, either a solid or tubular center conductor 16, a dielectric material 18 between the outer conductor 14 and the inner or center conductor 16 and a sheath 20 around the outer conductor 14. Generally, the components of the self clamping connector 10 include an outer conductor clamping back nut 30, a clamping collet 40 and a body 50. Each of these components will be described more fully below.

Figure 2:
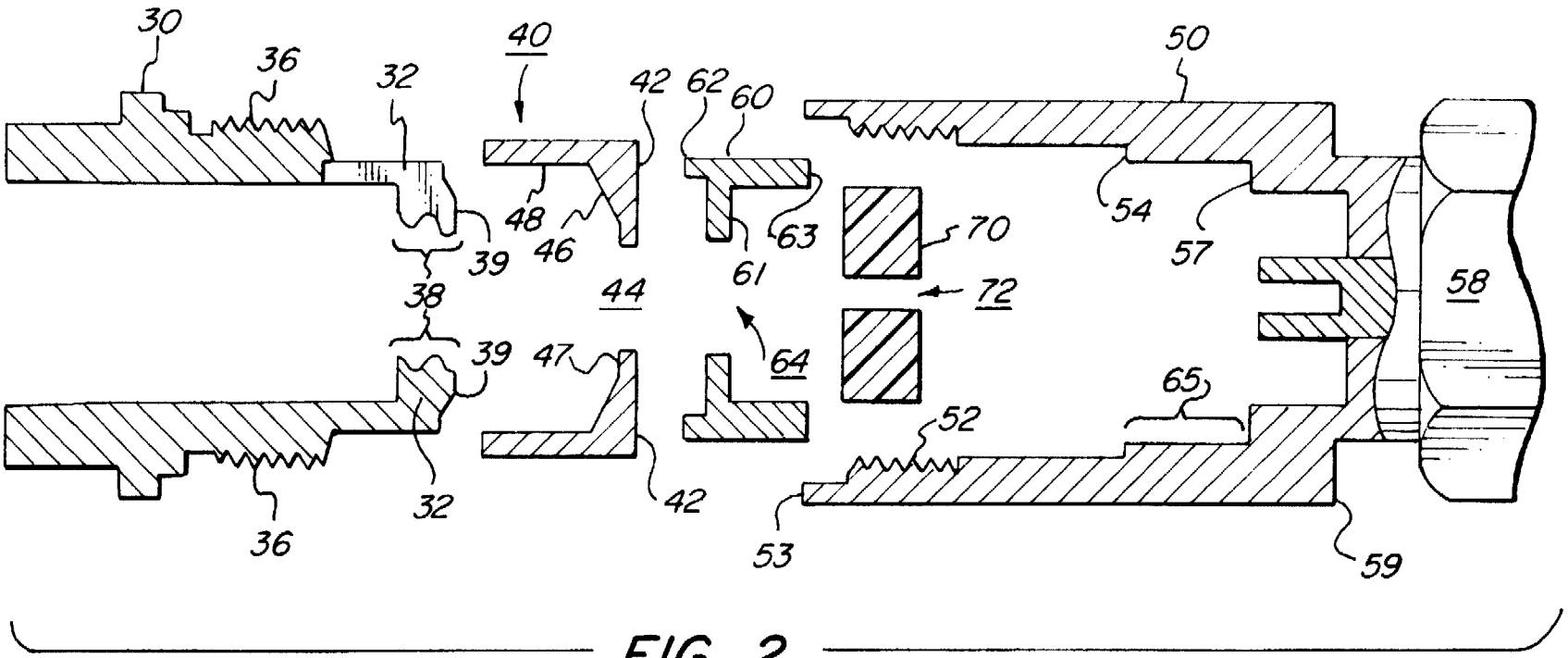
FIG. 2 which is an exploded cross-sectional view of the components of the connector of the present invention.
Figure 3:
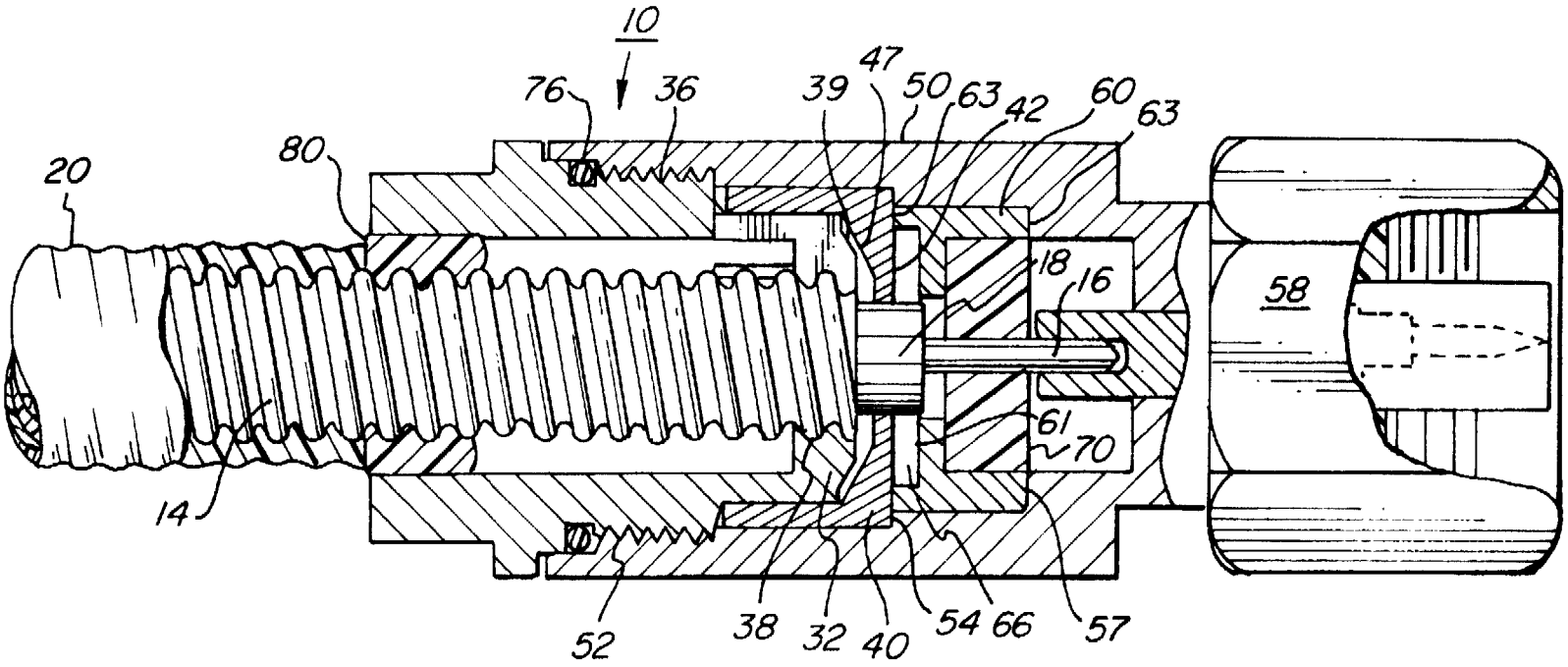
FIG. 3 which is a cross-sectional view of the fully assembled connector.
Figure 4:
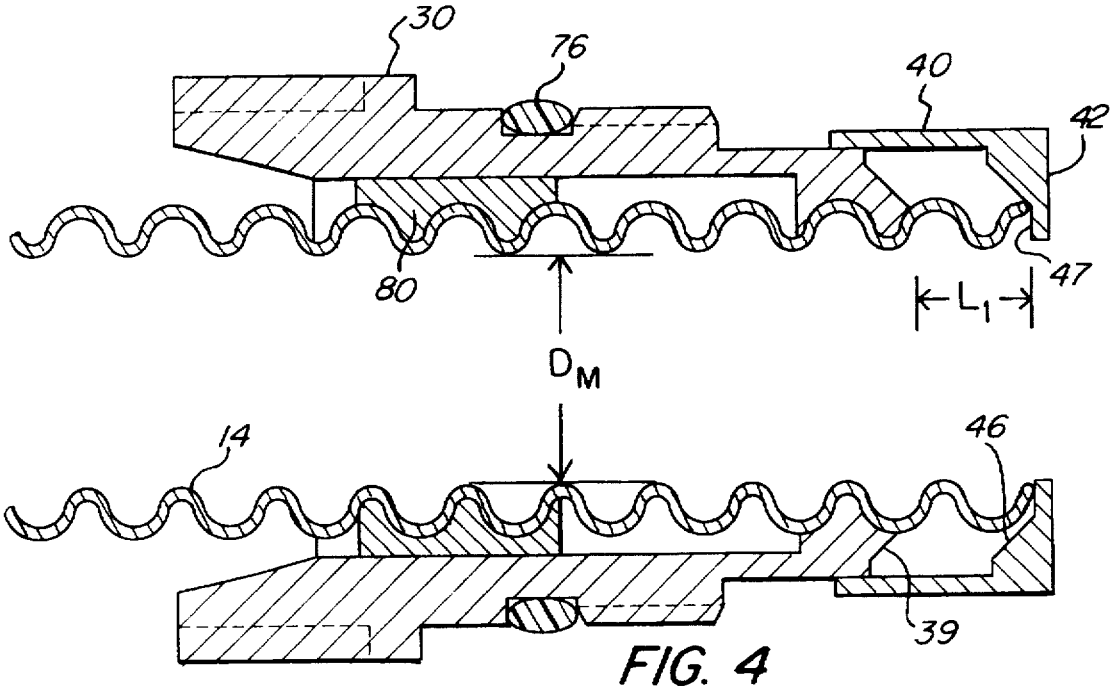
FIG. 4 which is a partial cross-sectional view of a partly assembled connector prior to the collapsing of a corrugation of the outer conductor.

Referring generally to FIGS. 1, 2 and 3, the clamping back nut 30 includes a plurality of resilient fingers 32 at one end, a wrench flat 34 at an opposite end and a threaded portion 36 on its outside diameter adjacent to the resilient fingers 32. Each of the resilient fingers 32 includes an interior threaded portion 38 and a beveled end 39. Collectively, the interior threaded portions 38 of all of the resilient fingers 32 form a threaded inside surface having a diameter, a thread depth and a pitch corresponding to the outside diameter, the thread depth and the pitch of the helically corrugated outer conductor 14. As shown in FIG. 4, the back nut 30 is typically threaded onto the outer conductor 14 such that the outer conductor 14 extends past beveled end 39 of the resilient fingers 32 by approximately length $L_1$. Length $L_1$, typically corresponds to about one pitch of the outer conductor corrugation.

Figure 5:
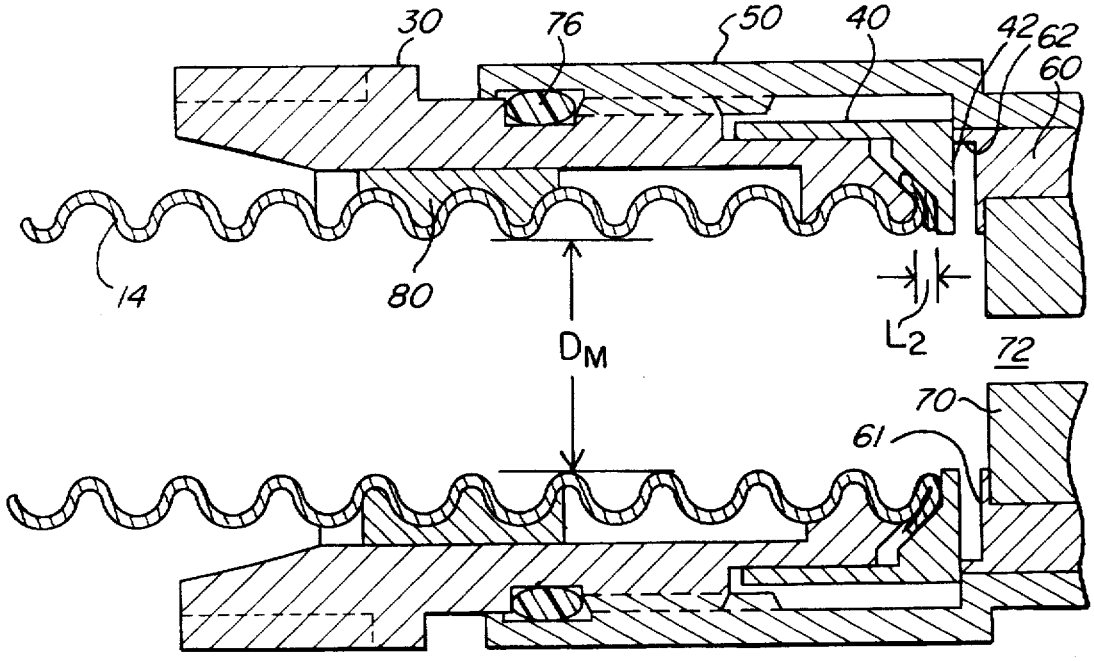
FIG. 5 which is a partial cross-sectional view of an assembled connector illustrating the collapsing of the corrugation of the outer conductor.

The clamping collet 40 of the connector 10 is cup shaped in cross-section with an opening 44 in base 42. The interior of the cup shaped clamping collet 40 includes a beveled shoulder portion 46 between the base 42 and side 48. The beveled portion 46 provides an inward radial force to close down the threads 38 of the resilient fingers 32 on the outer conductor 14 such that the fingers make intimate contact with the conductor 14. Preferably, opening 44 in base portion 42 of cup shaped clamping collet 40 has a diameter dimensioned substantially the same as the minimum diameter $D_m$ of the outer conductor 14. Making the opening this size allows the dielectric material 18 and inner conductor 16 to pass through the opening 44 when the connector 10 is assembled and ensures that the base 42 of the collet 40 is of sufficient size to allow clamping of the outer conductor 14, as explained below. The inside surface of the cup shaped collet 40 is dimensioned so as to snugly fit over the collective outside diameter of the plurality of resilient fingers 32 of the clamping back nut 30 when the fingers 32 are engaged with the outer conductor 14 of the cable 12. In the assembled state, the beveled end 39 of the resilient fingers 32 is typically adjacent to the beveled shoulder portion 46 of the cup shaped clamping collet 40. When the connector 10 is completely assembled, the single corrugation pitch that extends past the beveled end 39 of the resilient fingers 32 by Length $L_1$, as shown in FIG. 4 is collapsed or deformed, as shown in FIG. 5, to a length $L_2$ which is smaller than $L_1$, and the collapsed or deformed portion is clamped between the beveled end 39 of the back nut and the beveled shoulder 46 of collet 40.

Body 50 is generally cylindrically shaped and includes an interior threaded portion 52 at a first end 53 having a thread depth and pitch to allow coupling with the threaded portion 36 of the clamping back nut 30. Of course, those skilled in the art will appreciate that the length of outer conductor $L_1$ which is permitted to protrude out of the resilient fingers will dictate the exact positioning of the threads 52. The threads 52 must be able to cooperate with the threads 36 of the backnut 30 prior to collapsing of the outer conductor from $L_1$, to $L_2$ so as to enable the collapsing of the outer conductor. As best shown in FIGS. 2 and 3, a collet supporting shoulder 54 is provided within the body 50. When the connector 10 is assembled, the collet supporting shoulder 54 applies force to the base 42 of the cup shaped collet 40 to force and hold collet 40 over resilient fingers 32. The body 50 is also provided with wrench flats 56 and a conventional type N cable connector 58 is attached at a second end 59 of the body 50.

The connector 10 is further provided with a cylindrically shaped insert 60, made from a metal or metal alloy, such as brass, for example, having an inwardly facing flange 61 positioned between first end 62 and second end 63 defining opening 64. The flange 61 is dimensioned to allow the dielectric 18 and the inner conductor 16 to pass through opening 63. The insert 60 has an outside diameter substantially the same as the inside diameter of insert receiving portion 65 of body 50. When the connector 10 of the present invention is assembled, the second end 63 of the insert 60 rests upon an insert supporting shoulder 57 inside the body 50. Because the outside diameter of the insert 60 is smaller than the outside diameter of the cup shaped collet, the first end 62 of the insert 60 rests on and provides additional support to the base 42 of cup shaped collet 40. Referring to FIG. 3, when the connector is assembled, the base 42 of the cup shaped collet 40, the first end 62 and flange 61 of the insert 60, and the dielectric 18 form an annular shaped cavity 66 providing a high impedance section in the connector to compensate for the collapsed or deformed corrugation of the outer conductor clamped between the end 39 of the resilient fingers 32 and base 42 of the collet 40.

Referring to FIGS. 2 and 3, a dielectric insert 70 is positioned within the insert 60 on the side of the flange 61 adjacent to the second end 63. The dielectric insert 70 includes an opening 72 which is dimensioned to only allow the inner conductor 16 to pass therethrough. The dielectric insert 70 provides support for the center conductor 16 of the cable to prevent movement when the cable is flexed.

Finally, the connector 10 may be made essentially moisture proof by providing a body-back nut interface gasket 76 between the body 50 and the back nut 30, a outer conductor-back nut interface gasket 80 between the outer conductor 14 and the back nut, and heat shrink wrapping 90 which is placed over the connector 10.

As can be seen from the foregoing detailed description and drawings, the present invention provides a self clamping connector for coaxial radio frequency cables. Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. A connector for a radio frequency coaxial cable having a helically corrugated outer conductor, the connector comprising:

an outer conductor clamping back nut having a plurality of resilient fingers at one end, a threaded portion adjacent to the resilient fingers each of the resilient fingers including an outer conductor matching threaded portion;

a cup shaped collet, further including a base having an opening therein, positioned over the resilient fingers to clamp the fingers onto the helically corrugated outer conductor;

a body having an interior threaded portion at one end, a coupling at an opposite end, a collet supporting shoulder therein on which the base of the cup shaped collet rests when the connector is assembled, and an insert supporting shoulder; and a cylindrically shaped insert having an inwardly facing flange positioned between a first end and a second end, the flange further including an opening, wherein the first end of the insert rests on the base of the cup shaped collet and the second end of the insert rests on the insert supporting shoulder of the body, and wherein the base of the cup shaped collet, the first end and flange of the insert form a cylindrically shaped cavity, when the connector is assembled.

2. The connector of claim 1, further comprising a dielectric insert, having an opening therein dimensioned to receive an inner conductor of the radio frequency cable, wherein the dielectric insert is positioned within the insert on a side of the flange adjacent to its second end.

3. The connector of claim 1, wherein the cup shaped collet has a beveled interior portion between a wall and the base and wherein the resilient fingers include a beveled portion complimentary to the beveled interior portion of the collet.

4. The connector of claim 1, wherein the opening in the cup shaped collet has a diameter substantially the same as the minimum diameter of the outer conductor.

5. The connector of claim 1, further including a clamping back nutbody gasket positioned between the clamping back nut and the body at a position between one end of the body and its threaded portion.

6. A radio frequency coaxial cable assembly, the assembly comprising:

a radio frequency coaxial cable having a helically corrugated outer conductor, an inner conductor and a dielectric material between the inner conductor and the outer conductor and wherein the cable further has an end where the outer conductor, inner conductor and dielectric material terminate; and a self-clamping connector attached to the end of the radio frequency coaxial cable, the connector further comprising:

a clamping back nut having a plurality of resilient fingers at one end, a threaded portion adjacent to the resilient fingers, each of the resilient fingers including an outer conductor matching threaded portion, a cup shaped collet, further including a base having an opening therein, positioned over the resilient fingers to clamp the fingers onto the helically corrugated outer conductor, a body having an interior threaded portion at one end, a coupling at an opposite end and a collet supporting shoulder therein on which the base of the cup shaped collet rests when the connector is assembled, and a cylindrically shaped insert having an inwardly facing flange positioned between a first end and a second end, the flange further including an opening, wherein the first end of the insert rests on the base of the cup shaped collet and the second end of the insert rests on the insert supporting shoulder of the body when the connector is assembled; and wherein a portion of the outer conductor at the end of the cable is deformed and wherein the deformed portion of the outer conductor is clamped between the resilient fingers and the base of the cup shaped collet, and wherein the base of the cup shaped collet, the dielectric material of the cable, the first end and flange of the cylindrical insert form an annular cavity between the cup shaped collet and the cylindrically shaped insert.

7. The assembly of claim 6, further including a clamping back nutbody gasket positioned between the clamping back nut and the body at a position between the one end and the threaded portion of the body.

8. The assembly of claim 6, wherein the connector further includes a dielectric insert, having an opening therein dimensioned to receive the inner conductor of the radio frequency cable, wherein the dielectric insert is positioned within the insert adjacent to the flange on the side adjacent to the second end of the insert and wherein the inner conductor of the radio frequency cable passes through the opening in the dielectric insert.

9. The connector of claim 6, wherein the opening in the cup shaped collet has a diameter substantially the same as the minimum diameter of the outer conductor.

* * * * *